US006981726B2

(12) United States Patent
Huang

(10) Patent No.: US 6,981,726 B2
(45) Date of Patent: Jan. 3, 2006

(54) EASILY DISASSEMBLED STRUCTURE OF AN AUXILIARY LOCK

(75) Inventor: Tsung-Chung Huang, Min-Hsiung (TW)

(73) Assignee: Tong Lung Metal Industry Co., Ltd., Chiayi (TW)

( * ) Notice: Subject to any disclaimer, the term of this patent is extended or adjusted under 35 U.S.C. 154(b) by 0 days.

(21) Appl. No.: 10/759,587

(22) Filed: Jan. 16, 2004

(65) Prior Publication Data

US 2004/0145192 A1 Jul. 29, 2004

(30) Foreign Application Priority Data

Jan. 17, 2003 (TW) ..... 92200997 U

(51) Int. Cl.
*E05B 3/00* (2006.01)

(52) U.S. Cl. ..... 292/350; 292/347; 292/348; 292/DIG. 53; 70/134; 70/370

(58) Field of Classification Search ..... 292/350, 292/347–349, 353, 356–358, DIG. 53, DIG. 63, 292/DIG. 64, 336.3, 337; 70/134, 224, 370, 70/451, 452, 472

See application file for complete search history.

(56) References Cited

U.S. PATENT DOCUMENTS

| | | | | | |
|---|---|---|---|---|---|
| 201,906 | A | * | 4/1878 | Brady | 292/351 |
| 1,103,963 | A | * | 7/1914 | Harlow et al. | 292/350 |
| 1,663,417 | A | * | 3/1928 | Schunck et al. | 292/355 |
| 2,123,539 | A | * | 7/1938 | Morgen | 292/347 |
| 2,216,467 | A | * | 10/1940 | Falk | 292/347 |
| 2,296,020 | A | * | 9/1942 | Carter | 292/139 |
| 2,473,937 | A | * | 6/1949 | Cameron | 292/348 |
| 2,698,763 | A | * | 1/1955 | Young | 292/347 |
| 3,044,817 | A | * | 7/1962 | Marcante | 292/336.3 |
| 3,234,765 | A | * | 2/1966 | Kerr | 70/208 |
| 3,955,387 | A | * | 5/1976 | Best et al. | 70/224 |
| 4,052,868 | A | * | 10/1977 | Best et al. | 70/224 |
| 4,321,810 | A | * | 3/1982 | Wildenradt | 70/129 |
| 4,588,221 | A | * | 5/1986 | Miller et al. | 292/348 |
| 4,756,638 | A | * | 7/1988 | Neyret | 403/261 |
| 4,884,834 | A | * | 12/1989 | Ozagir et al. | 292/350 |
| 4,998,760 | A | * | 3/1991 | Nixon et al. | 292/347 |
| 5,067,758 | A | * | 11/1991 | Fann et al. | 292/347 |

(Continued)

FOREIGN PATENT DOCUMENTS

| | | | |
|---|---|---|---|
| EP | 549856 | * | 7/1993 |

(Continued)

*Primary Examiner*—Daniel P. Stodola
*Assistant Examiner*—Carlos Lugo
(74) *Attorney, Agent, or Firm*—Senniger Powers

(57) ABSTRACT

An auxiliary lock assembly comprises a housing having a hole, wherein a protrusion radially and inwardly provided on the periphery of the hole; a shaft with various cross-sectional area inserted into the hole of the housing; a longitudinal groove formed on the exterior of the shaft; a circumferential groove formed on the exterior of the shaft and communicating with the longitudinal groove to provide engagement with the protrusion on the housing; an axial hole formed in the axial direction of the shaft; a cover having a hole aligned with the hole of the housing for allowing the shaft to pass through; a knob having an axle portion; an axial hole formed in an axial direction in the knob for allowing the shaft to be inserted therein; a threaded hole formed in a transverse direction in the axle portion of the knob; and a fastening screw being able to thread into the threaded hole and secure the shaft and the knob together.

9 Claims, 4 Drawing Sheets

U.S. PATENT DOCUMENTS 5,190,327 A * 3/1993 Lin ..... 292/348
5,236,235 A * 8/1993 Gustafson et al. ..... 292/357
5,297,405 A * 3/1994 Manning et al. ..... 70/208
5,316,355 A * 5/1994 Hartwell et al. ..... 292/347
5,447,047 A * 9/1995 Lin ..... 70/218
5,556,144 A * 9/1996 Lin ..... 292/336.3
5,722,273 A * 3/1998 Lin et al. ..... 70/370

FOREIGN PATENT DOCUMENTS

GB 2013271 * 8/1979

* cited by examiner

EASILY DISASSEMBLED STRUCTURE OF AN AUXILIARY LOCK

FIELD OF INVENTION

The present invention is related to an easily disassembled structure of an auxiliary lock, particularly to the internal lock body of an auxiliary lock having a structure that can be easily assembled and disassembled.

BACKGROUND

The internal lock body of the conventional auxiliary locks generally comprises an inner housing having two spaced through holes and a hole located therebetween; a shaft to be inserted into the hole of the inner housing and having two opposing ends, wherein one end has a circumferential groove for engaging with C-ring and the other has a transverse hole; a cover having a hole aligned with the hole in the inner housing so as to allow the shaft to pass through; a knob having an axle portion with an axial hole for fitting over one end of the shaft, wherein the axle portion has a transverse hole aligned with the transverse hole of the shaft so as to allow a pin to be inserted therein and therefore secure the shaft and the knob together.

With the lock structure as described above, since a C-ring is used to secure one end of the shaft to the inner housing, tools will be needed in assembling the locks in workshops. The assembling procedures would be very time-consuming. Furthermore, if any defect is found in a component of the locks and the component needs to be replaced during the assembling procedure, it will be found that disassembling the locks is very difficult. In addition, when installing a lock onto a door, the pin should be unfastened from the transverse hole of the knob first before the knob and the shaft can be separated. After the cover is unfastened and the inner housing is aligned with the outer housing, and two screws pass through the holes of the inner housing and thus secure the inner housing and the outer housing together, the cover is mounted, the knob is fit over the shaft, and the pin is inserted into the transverse hole after the knob is aligned with the shaft so that the knob and the shaft can be secured together. Such assembling job is complicated and difficult for ordinary users without skilled technique.

SUMMARY OF INVENTION

The primary objective of the present invention is to provide an easily disassembled auxiliary lock so that the interior of the lock body has the advantageous features of being easily assembled and easily disassembled.

The secondary objective of the present invention is to provide an easily disassembled auxiliary lock so that the interior of the lock body can be easily manufactured and assembled.

The easily disassembled auxiliary lock of the present invention comprises a housing having a hole and a protrusion radially and inwardly provided on the periphery of the hole; a shaft with a various cross-sectional area being inserted into the hole of the housing; a longitudinal groove formed on the exterior of the shaft; a circumferential groove formed on the exterior of the shaft and in communication with the longitudinal groove providing engagement with the protrusion on the housing; an axial hole formed in the axial direction of the shaft; a cover having a hole aligned with the hole of the housing for allowing the shaft to pass through; a knob having an axle portion; an axial hole formed in an axial direction in the knob for allowing the shaft to be inserted therein; a threaded hole formed in a transverse direction in the axle portion of the knob; and a fastening screw capable of threading into the threaded hole, and securing the shaft and the knob together.

DETAILED DESCRIPTION OF PREFERRED EMBODIMENT OF THE INVENTION

Figure 1:
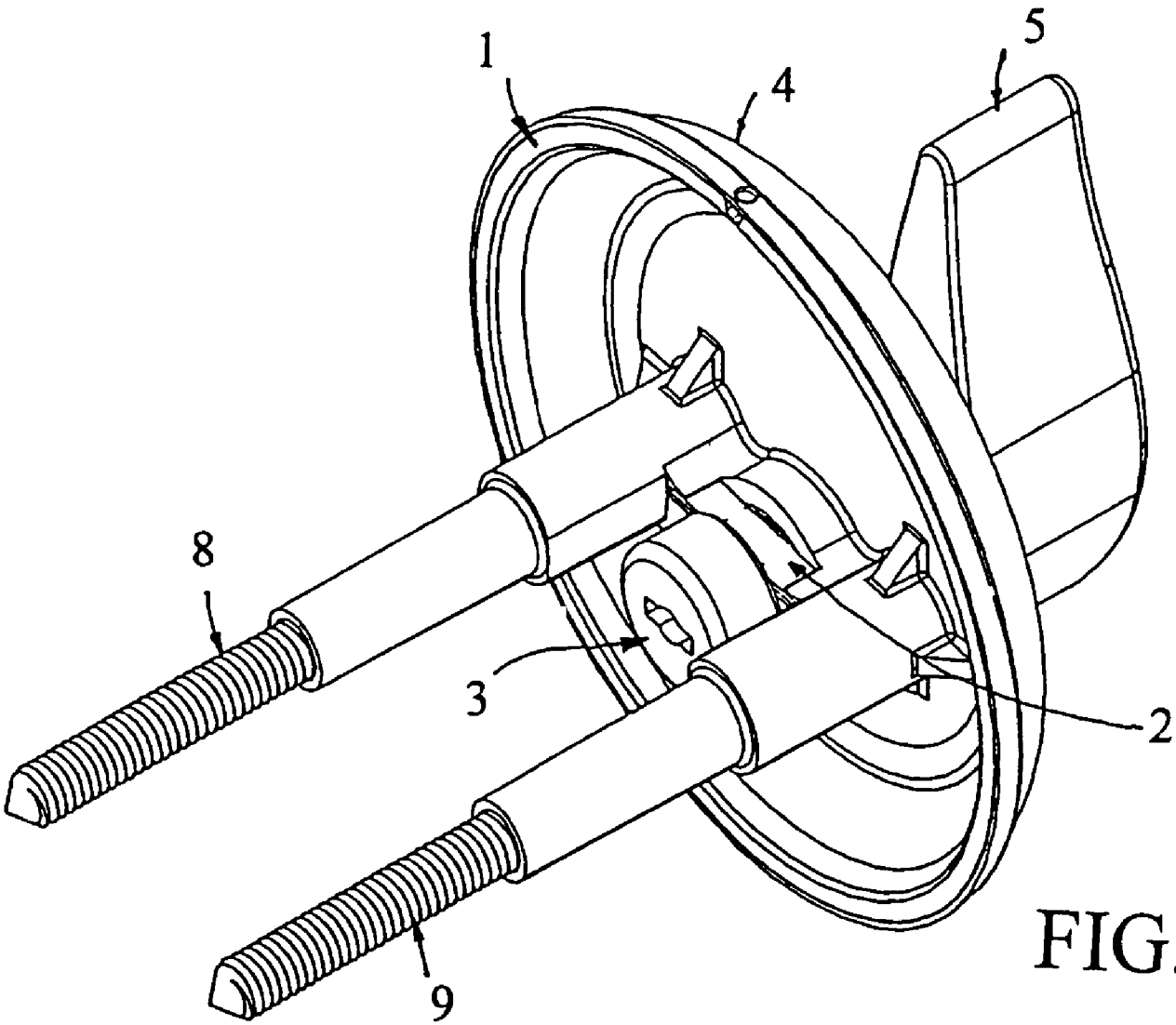
FIG. 1 is a perspective view of an easily disassembled auxiliary lock of the present invention in assembled condition.
Figure 2:
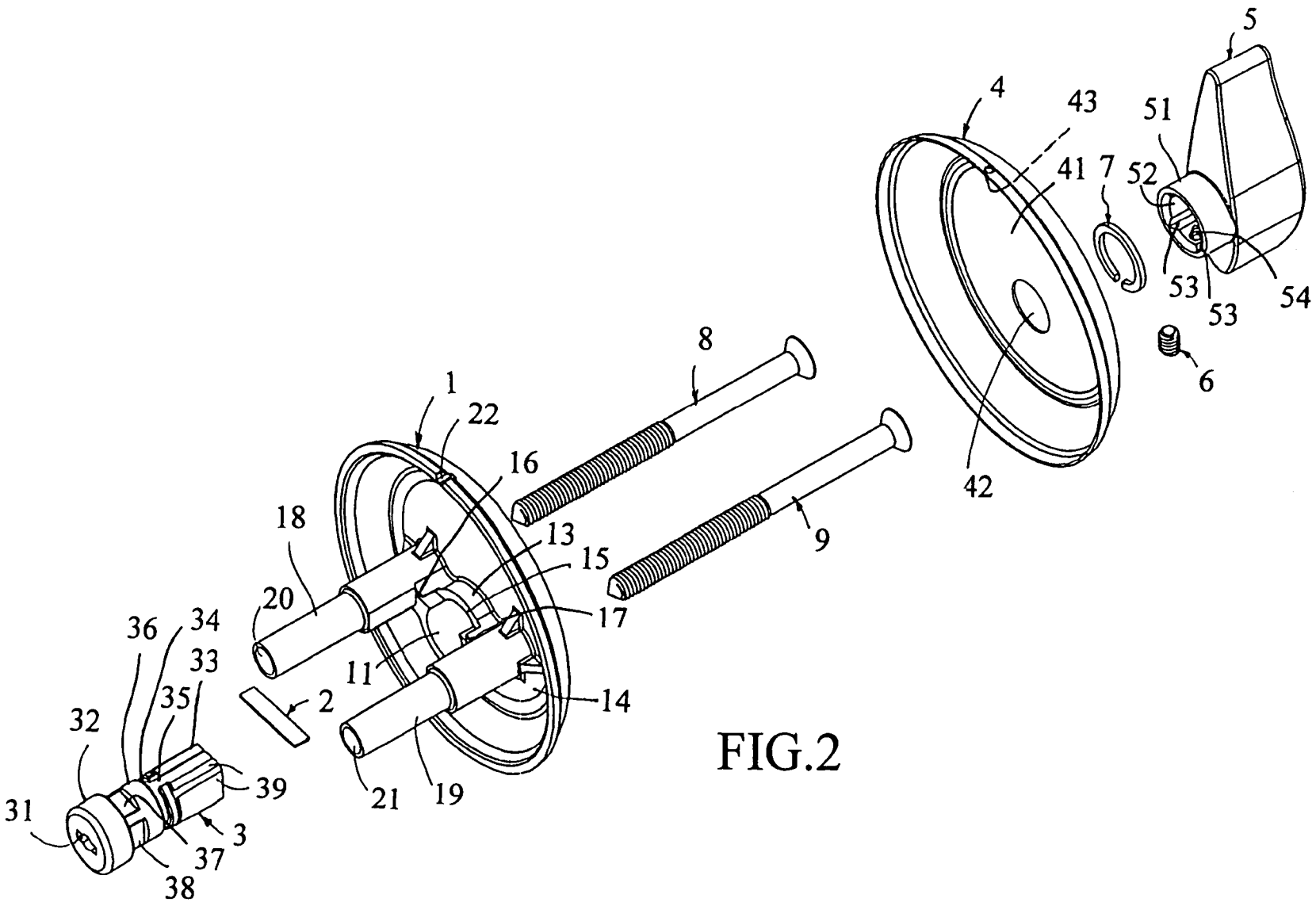
FIG. 2 is a perspective view of an easily disassembled auxiliary lock of the present invention in exploded condition.
Figure 3:
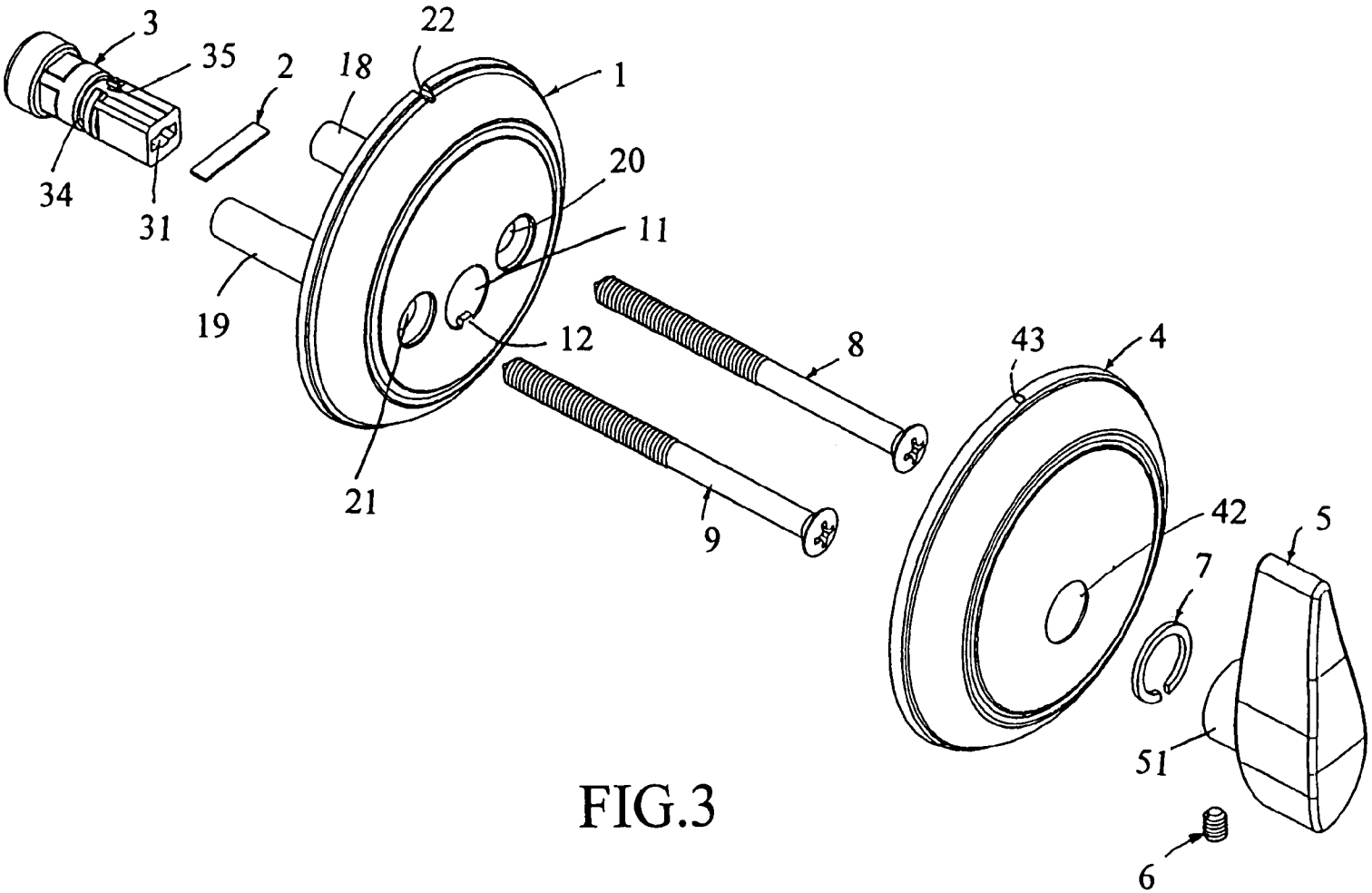
FIG. 3 is another perspective view of an easily disassembled auxiliary lock of the present invention in exploded condition.
Figure 4:
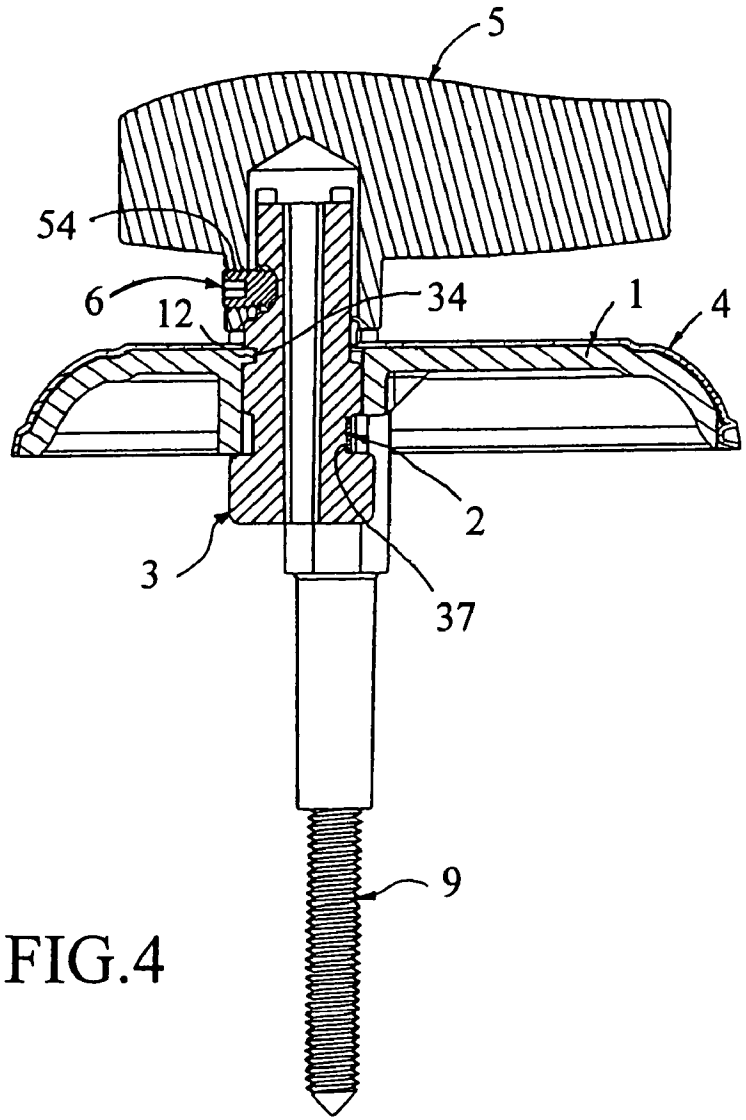
FIG. 4 is a cross-sectional view of an easily disassembled auxiliary lock of the present invention.

As shown in FIGS. 1 to 4, the present invention is related to an easily disassembled structure of an auxiliary lock, comprising: a housing 1 having a protrusion 12 (see FIG. 3) radially and inwardly provided on the periphery of a hole 11; an inner ring 13 axially provided near the periphery of the hole 11, wherein one end of the inner ring 13 is formed by the extension from the base surface 14, and the other end of the inner ring 13 has a cut-out 15, and two spaced notches 16, 17 are formed near the cut-out 15; a resilient positioning member 2 having two ends inserted into the notches 16, 17, respectively.

Two posts 18, 19 having through holes 20, 21, respectively, are provided near the inner ring 13 and each axially extend from the base surface 14 in spaced manner. A circular surface is formed around the base surface 14 of the housing 1, and the circumferential surface of the circular surface forms a positioning portion 22.

A shaft 3 having a body with different cross-section is inserted into the hole 11 of the housing 1. The shaft 3 has an axial hole 31 formed axially along the shaft 3 for allowing the shaft (not shown) of the external lock body to be inserted therein. The shaft 3 has a first section 32 and a second section 33, and a circumferential groove 34 is formed between the first section 32 and the second section 33. The second section has a longitudinal groove 35 in communication with the circumferential groove 34. A third section 36 is formed between the first section 32 and the circumferential groove 34. There are a first surface 37 and a second surface 38 adjacent to the first section. The first surface 37 and the second surface 38 are substantially perpendicular. In an embodiment, two spaced and parallel first surfaces 37 and two spaced and parallel second surfaces 38 can be provided. The second section 33 has multiple planes 39.

A cover 4 substantially in the shape of a disk has a base 41. A hole corresponding to the hole 11 of the housing 1 is provided on the base 41. The base 41 forms a circumstantial sidewall which further forms an engaging portion 43 protruding out from the base 41 and is adapted to engage with the recess 22 on the housing 1.

A knob 5 has an axle portion 51 extending axially. An axial hole 52 is formed inwardly from the end face of the axle portion 51. Four spaced grooves 53 (only two of them shown in FIG. 2) are formed on an inner wall of the axial hole to be in communication with the axial hole 52.

A threaded hole 54 is formed transversely on the axle portion 51 and is in communication with the axial hole 52.

A fastening screw 6, during assembly, is threaded into the threaded hole 54 of the axle portion 51 and engages with the circumferential groove 34 of the shaft 3 so that the shaft 3 and the axle portion 5 are fastened together.

A washer 7 having resilience is fitted over the shaft 3 during assembly and is positioned between the cover 4 and the knob 5 so as to reduce the friction therebetween.

Two screws 8, 9 are inserted into the through holes 20, 21 of the housing 1, respectively, so as to fasten the housing 1 and the external lock body (not shown) together.

When assembling the lock, the longitudinal groove 35 of the shaft 3 is aligned with the protrusion 12 of the housing 1, and the second section 33 of the shaft 3 is inserted into the hole 11 of the housing 1 so that the circumferential groove 34 of the shaft 3 can be aligned with the protrusion 12 of the housing 1. Then, the shaft 3 is rotated 180 degrees relative to the housing 1 so that the circumferential groove 34 of the shaft 3 can be engaged with the protrusion 12 of the housing 1. The positioning member 2 in the housing 1 can exactly contact the first surface 37 of the shaft 3 so that the shaft 3 is fixed in position. Then the two screws 8, 9 are inserted into the through holes 20, 21 of the housing 1, respectively, and are fastened with the external lock body (not shown).

Subsequently, the cover 4 is assembled with the second section 33 of the shaft inserted through the hole 42 so that the engaging portion 43 is engaged with the recess 22 of the housing 1. The washer 7 is then fitted over the second section 33 of the shaft 3, and the second section 33 of the shaft 3 is inserted into the axial hole 52 of the axle portion 51 of the knob 5 so that the planes 39 of the shaft 3 are engaged with the grooves 53 of the knob 5. The screw 6 is threaded into the threaded hole 54 of the knob 5 to secure the shaft 3 in the axial hole 52 so that the internal lock body of the auxiliary lock is assembled. In case the internal lock body of the auxiliary lock is to be disassembled, the above assembling procedures are reversed.

Therefore, when either the lock is to be assembled or disassembled, only a screwdriver is needed to carry out the procedures without any special tools (like a tool for dismounting a C-ring).

What is claimed is:

1. An auxiliary lock assembly comprising:

a housing having a hole and a protrusion radially and inwardly formed on a periphery of the hole;

a shaft having various cross-sectional areas, the shaft being adapted to be inserted into the hole of the housing;

a longitudinal groove formed on an exterior of the shaft;

a circumferential groove formed on the exterior of the shaft, the circumferential groove being in communication with the longitudinal groove to provide engagement with the protrusion on the housing;

an axial hole axially formed in the shaft;

a cover having a hole aligned with the hole of the housing for allowing the shaft to pass therethrough;

a knob having an axle portion;

an axial hole axially formed in the knob for allowing the shaft to be inserted therein;

a threaded hole transversely formed in the axle portion of the knob; and a screw being adapted to be screwed into the threaded hole of the axle portion of the knob to fasten the shaft with the knob.

2. An auxiliary lock assembly according to claim 1, wherein the housing has an inner ring axially formed adjacent to the periphery of the hole, of which the inner ring has a cut-out and two notches formed adjacent to the cut-out with the two notches being spaced apart from each other in light of the cut-out, and wherein the structure further comprises a positioning member having two ends adapted to be respectively disposed in the two notches.

3. An auxiliary lock assembly according to claim 1, wherein the housing has two posts spaced apart from each other with each of the posts having a through hole for allowing a screw to be threaded therethrough.

4. An auxiliary lock assembly according to claim 1, wherein the cover is in a shape of a disk, the cover further has a circumstantial sidewall and an engaging portion formed thereon, and wherein the housing has positioning portion being adapted to engage with the engaging portion of the cover.

5. An auxiliary lock assembly according to claim 2, wherein the shaft has a first section and a second section, of which the circumferential groove is formed between the first section and the second section, the longitudinal groove is formed on the second section, and the circumferential groove is in communication with the longitudinal groove.

6. An auxiliary lock assembly according to claim 5, wherein the shaft further comprises a third section, a first surface and a second surface, of which the third section is formed between the first section and the circumferential groove, and the first surface and the second surface are adjacent to the first section.

7. An auxiliary lock assembly according to claim 6, wherein the positioning member is adapted to be selectively in contact one of the first surface and the second surface.

8. An auxiliary lock assembly according to claim 7, wherein the axial hole of the knob has a plurality of spaced grooves formed on an inner wall of the axial hole to be in communication with the axial hole for allowing the second section of the shaft to engaget with the axle portion.

9. An auxiliary lock assembly according to claim 1, further comprising a washer provided between the cover and the axle portion of the knob.

* * * * *